US009555635B2

(12) United States Patent
Nakata et al.

(10) Patent No.: US 9,555,635 B2
(45) Date of Patent: Jan. 31, 2017

(54) LIQUID SUPPLY SYSTEM

(71) Applicant: Seiko Epson Corporation, Tokyo (JP)

(72) Inventors: Satoshi Nakata, Matsumoto (JP); Tomoyuki Kurata, Matsumoto (JP); Kazumasa Harada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/955,710

(22) Filed: Dec. 1, 2015

(65) Prior Publication Data

US 2016/0152037 A1 Jun. 2, 2016

(30) Foreign Application Priority Data

Dec. 2, 2014 (JP) ..... 2014-243732

(51) Int. Cl.
*B41J 2/175* (2006.01)

(52) U.S. Cl.
CPC ..... *B41J 2/17503* (2013.01); *B41J 2/1752* (2013.01); *B41J 2/17513* (2013.01); *B41J 2/17553* (2013.01)

(58) Field of Classification Search
CPC ... B41J 2/17513; B41J 2/1752; B41J 2/17523; B41J 2/17553
See application file for complete search history.

(56) References Cited

U.S. PATENT DOCUMENTS 5,975,330 A * 11/1999 Sasaki ..... B41J 2/17523 220/23.91
7,004,575 B2 * 2/2006 Inoue ..... B41J 2/17503 347/86
7,556,362 B2 * 7/2009 Akahane ..... G05D 16/0672 347/40
2002/0085075 A1 * 7/2002 Shinada ..... B41J 2/17513 347/86
2003/0214557 A1 * 11/2003 Nakamura ..... B41J 2/1752 347/49
2008/0049080 A1 2/2008 Hayashi et al.
2008/0049081 A1 2/2008 Hayashi et al.
2014/0362145 A1 * 12/2014 Studer ..... B41J 2/175 347/85

FOREIGN PATENT DOCUMENTS

JP 2008-074090 A 4/2008
JP 2008-074100 A 4/2008

* cited by examiner

*Primary Examiner* — Stephen Meier
*Assistant Examiner* — John P Zimmermann

(57) ABSTRACT

A liquid supply system adapted to be mounted in a carriage unit having a first liquid introduction portion and a second liquid introduction portion is proposed. The liquid supply system comprises two liquid supply units each having liquid supply portion adapted to liquid to the first and second liquid introduction portions, respectively. The two liquid supply units are adapted to be attached to and detached from the carriage unit. The liquid supply system further comprises a holder unit adapted to be attached to and detached from the carriage unit and adapted to fix the two liquid supply units to the carriage unit. The two liquid supply units are located between the holder unit and the carriage unit.

16 Claims, 8 Drawing Sheets

LIQUID SUPPLY SYSTEM

BACKGROUND

1. Technical Field

The present invention relates to liquid supply systems equipped with liquid supply units that supply liquid to liquid ejection apparatuses.

2. Related Art

Printers are widely used as a kind of liquid ejection apparatuses, and ink cartridges are used as liquid supply units for the printers. Hitherto, with a printer that prints using ink of a plurality of colors, independent ink cartridges are prepared for respective ink colors and are independently attached to and detached from the printer. However, in the case of using independent ink cartridges for the respective ink colors, if the number of ink colors increases, the structure of a cartridge attaching portion becomes complicated as a result of enabling many ink cartridges to be attached, which is disadvantageous for a size reduction of the printer. In addition, the operation of replacing the ink cartridges takes time and effort.

A printer has been proposed to which an integrated ink cartridge that contains ink of a plurality of colors is attached to perform. For example, JP-A-2008-74100 discloses an ink tank (ink cartridge) in which the inside of a housing thereof is partitioned into a plurality of ink containing portions and an ink supply port is provided in each ink containing portion. The ink tank has a plurality of lock portions, and is attached to the printer by engaging these lock portions with lock portions on the printer side.

With an integrated ink cartridge such as the one disclosed in JP-A-2008-74100, time and effort in the operation of replacing the ink cartridge can be reduced since a plurality of ink cartridges are integrated. Furthermore, an integrated ink cartridge is more space-saving than a plurality of ink cartridges are, and allows the configuration of a cartridge attaching portion to be simplified. Accordingly, an integrated ink cartridge is advantageous for a size reduction of a printer.

However, although an integrated ink cartridge is advantageous in terms of a size reduction and time and effort in replacement, an entire ink cartridge needs to be replaced if the remaining amount of ink of only one of the plurality of ink colors becomes small. Accordingly, a problem arises in that the ink is wasted. For this reason, there has been a demand for an ink cartridge that is advantageous for a size reduction and time and effort in replacement and with less waste of ink. This problem is not limited to ink cartridges for printers, but is also a problem shared by liquid supply systems for other kinds of liquid ejection apparatuses.

SUMMARY

The invention has been made in order to solve at least a part of the above-described problem, and can be achieved as the following modes or application examples.

A mode of the invention is a liquid supply system adapted to be mounted in a carriage unit having a first liquid introduction portion and a second liquid introduction portion, including: a first liquid supply unit having a first liquid supply portion adapted to supply first liquid to the first liquid introduction portion and adapted to be attached to and detached from the carriage unit; a second liquid supply unit having a second liquid supply portion adapted to supply second liquid to the second liquid introduction portion and adapted to be attached to and detached from the carriage unit independently of the first liquid supply unit; and a holder unit adapted to be attached to and detached from the carriage unit and adapted to fix the first liquid supply unit and the second liquid supply unit to the carriage unit, wherein when a plane in which the first liquid supply portion abuts against the first liquid introduction portion in a state where the first liquid supply unit is attached to the carriage unit is defined as a reference plane, and a direction perpendicular to the reference plane is defined as an attaching direction, the first liquid supply unit is located between the holder unit and the carriage unit in the attaching direction, the second liquid supply unit is located between the holder unit and the carriage unit in the attaching direction, and the holder unit has a terminal portion adapted to be electrically connected to the carriage unit.

According to this mode, the first liquid supply unit and the second liquid supply unit can be independently replaced, whereas both the first liquid supply unit and the second liquid supply unit can be fixed to the carriage unit using the holder unit, which is a single member. Accordingly, it is possible to achieve both a reduction in time and effort in replacement and a reduction in waste of ink. In addition, the terminal portion can be arranged in the holder unit instead of arranging a terminal portion in each of the first liquid supply unit and the second liquid supply unit. Accordingly, the size of the liquid supply system can be reduced.

A mode of the invention is a liquid supply system adapted to be mounted in a carriage unit having a first liquid introduction portion and a second liquid introduction portion, including: a first liquid supply unit having a first liquid supply portion adapted to supply first liquid to the first liquid introduction portion and adapted to be attached to and detached from the carriage unit; a second liquid supply unit having a second liquid supply portion adapted to supply second liquid to the second liquid introduction portion and adapted to be attached to and detached from the carriage unit independently of the first liquid supply unit; and a holder unit adapted to be attached to and detached from the carriage unit and adapted to fix the first liquid supply unit and the second liquid supply unit to the carriage unit, wherein when a plane in which the first liquid supply portion abuts against the first liquid introduction portion in a state where the first liquid supply unit is attached to the carriage unit is defined as a reference plane, and a direction perpendicular to the reference plane is defined as an attaching direction, the first liquid supply unit is located between the holder unit and the carriage unit in the attaching direction, the second liquid supply unit is located between the holder unit and the carriage unit in the attaching direction, and the holder unit has a first engaging portion and a second engaging portion that can engage with the carriage unit.

According to this mode, the first liquid supply unit and the second liquid supply unit can be independently replaced, whereas both the first liquid supply unit and the second liquid supply unit can be fixed to the carriage unit using the holder unit, which is a single member. Accordingly, it is possible to achieve both a reduction in time and effort in replacement and a reduction in waste of ink. In addition, the engaging portion can be arranged in the holder unit instead of arranging an engaging portion in each of the first liquid supply unit and the second liquid supply unit. Accordingly, the size of the liquid supply system can be reduced.

In a mode of the invention, it is desirable that the first liquid supply unit has a first atmosphere communication hole, and the holder unit has a first atmosphere release opening adapted to be in communication with the first atmosphere communication hole. With this configuration, it is less likely that the first atmosphere communication hole of the first liquid supply unit is blocked by the holder unit.

In a mode of the invention, it is desirable that when a direction in which the carriage unit scans is defined as a main scanning direction, the first liquid supply unit has a first restriction portion adapted to restrict movement in the main scanning direction with respect to the holder unit when the first liquid supply unit is attached to the carriage unit. With this configuration, movement of the first liquid supply unit in the main scanning direction can be restricted when the first liquid supply unit is fixed to the carriage unit using the holder unit.

In a mode of the invention, it is desirable that when a direction in which the carriage unit scans is defined as a main scanning direction, the first liquid supply unit has a first restriction portion adapted to restrict movement in a direction intersecting the attaching direction and the main scanning direction with respect to the holder unit when the first liquid supply unit is attached to the carriage unit. With this configuration, movement of the first liquid supply unit in the direction intersecting the main scanning direction and the attaching direction can be restricted when the first liquid supply unit is fixed to the carriage unit using the holder unit.

In a mode of the invention, it is desirable that when a direction in which the carriage unit scans is defined as a main scanning direction, the first liquid supply unit and the second liquid supply unit are configured to be arranged side-by-side in a direction orthogonal to the main scanning direction when the first liquid supply unit and the second liquid supply unit are attached to the carriage unit, the first liquid supply unit has a first restriction portion adapted to restrict movement in the main scanning direction with respect to the holder unit when the first liquid supply unit is attached to the carriage unit, the second liquid supply unit has a second restriction portion adapted to restrict movement in the main scanning direction with respect to the first liquid supply unit when the second liquid supply unit is attached to the carriage unit, and the holder unit has a third restriction portion adapted to restrict movement in the main scanning direction with respect to the second liquid supply unit when the second liquid supply unit is attached to the carriage unit. With this configuration, when the first liquid supply unit and the second liquid supply unit are arranged side-by-side in the direction orthogonal to the main scanning direction when the first and second liquid supply units are attached to the carriage unit, even if the force exerted in the main scanning direction is applied by sliding of the carriage unit, it is less likely that the positions of the first liquid supply unit and the second liquid supply unit move in the main scanning direction. In addition, since the liquid supply units can restrict movement thereof among them, the configuration of the holder unit can be simplified. Accordingly, this mode is advantageous for a size reduction.

In a mode of the invention, it is desirable that when the first restriction portion and the second restriction portion are viewed in a plan view in the attaching direction in a state where the first liquid supply unit and the second liquid supply unit are attached to the carriage unit, positions of the first restriction portion and the second restriction portion in the main scanning direction are different from each other. With this configuration, the first liquid supply unit and the second liquid supply unit can be prevented from being incorrectly attached.

In a mode of the invention, it is desirable that a third liquid supply unit is further included that has a third liquid supply portion adapted to supply third liquid to the carriage unit and adapted to be attached to and detached from the carriage unit independently of the first liquid supply unit and the second liquid supply unit, wherein when a direction in which the carriage unit scans is defined as a main scanning direction, the first liquid supply unit and the second liquid supply unit are configured to be arranged side-by-side in a direction orthogonal to the main scanning direction when the first liquid supply unit and the second liquid supply unit are attached to the carriage unit, the first liquid supply unit and the third liquid supply unit are configured to be arranged side-by-side in the direction orthogonal to the main scanning direction when the first liquid supply unit and the third liquid supply unit are attached to the carriage unit, and the second liquid supply unit and the third liquid supply unit are configured to be arranged side-by-side in the main scanning direction when the second liquid supply unit and the third liquid supply unit are attached to the carriage unit. With this configuration, the three liquid supply units can be efficiently arranged. In addition, since the liquid supply units can restrict movement thereof among them, the configuration of the holder unit can be simplified. Accordingly, this mode is advantageous for a size reduction.

A mode of the invention is any of the above-described liquid supply systems further including: a liquid container; and a first liquid supply tube that connects the first liquid supply unit to the liquid container. The liquid supply system in this mode can supply liquid from the liquid container to the first liquid supply unit. Accordingly, the size of the first liquid supply unit can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of a liquid supply unit and a liquid supply system to which the invention is applied will be described with reference to the drawings.

Embodiment 1

Overall Configuration

Figure 1:
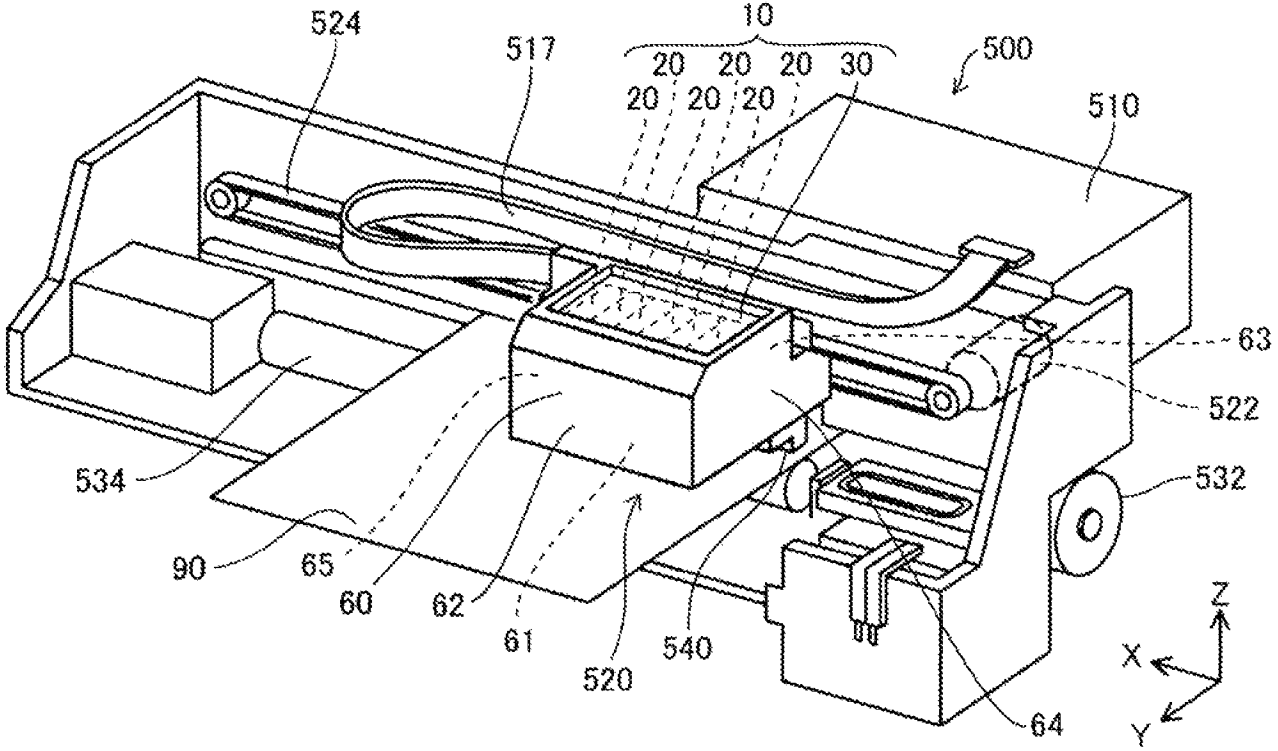
FIG. 1 is a perspective view of a printer to which ink cartridges according to Embodiment 1 of the invention is attached.

FIG. 1 is a perspective view of a printer to which ink cartridges according to Embodiment 1 of the invention are attached. A printer 500, which serves as a liquid ejection apparatus, includes a control unit 510 that controls each part of the printer 500, a carriage unit 520, a main scanning feed mechanism that moves the carriage unit 520 back and forth in a main scanning direction, and a sub-scanning feed mechanism that conveys a print medium P in a sub-scanning direction orthogonal to the main scanning direction. As will be described later, ink cartridges 20, each serving as a liquid supply unit, are attached to the carriage unit 520 so as to be held by a holder unit 30.

In this specification, an X direction, a Y direction, and a Z direction are three directions orthogonal to one another. Regarding each of the three, namely XYZ directions shown in FIG. 1, the orientation of the arrow indicates a + direction (positive direction), and the orientation opposite to the arrow orientation indicates a − direction (negative direction). The printer 500, when in use, is arranged on an XY plane, which is a horizontal plane. At this time, the X direction is a direction parallel with the main scanning direction (the left-right direction of the printer 500) in which the carriage unit 520 is moved back and forth, and the Y direction is a direction parallel with the sub-scanning direction (the front-rear direction of the printer 500) in which the print medium P is conveyed. The +Y direction indicates forward, and the −Y direction indicates rearward. The Z direction is the vertical direction (the up-down direction of the printer 500), and the −Z direction is the vertically downward direction.

A main scan mechanism of the printer 500 includes a carriage motor 522 and a drive belt 524 that is looped in the main scanning direction, and the power of the carriage motor 522 is transmitted to the carriage unit 520 via the drive belt 524. A sub-scan mechanism includes a conveyance motor 532 and a platen roller 534, and the print medium P is conveyed using the power of the conveyance motor 532 via the platen roller 534. The carriage motor 522 and the conveyance motor 532 operate based on a control signal from the control unit 510.

The control unit 510 and the carriage unit 520 are electrically connected via a flexible cable 517. The carriage unit 520 includes a cartridge attaching portion 60 to which the holder unit 30 and a plurality of ink cartridges 20 are attached, and a print head 540 arranged below the cartridge attaching portion 60. The print head 540 operates based on a control signal from the control unit 510, and discharges ink toward the print medium P. The print medium P is thereby printed.

Ink Supply System

As shown in FIG. 1, the carriage unit 520 includes a bottom wall portion 61 that constitutes a bottom portion of the cartridge attaching portion 60, a first side wall portion 62 that constitutes a wall surface of the cartridge attaching portion 60 in the +Y direction, a second side wall portion 63 that constitutes a wall surface of the cartridge attaching portion 60 in the −Y direction, a third side wall portion 64 that constitutes a wall surface of the cartridge attaching portion 60 in the −X direction, and a fourth side wall portion 65 that constitutes a wall surface of the cartridge attaching portion 60 in the +X direction. The print head 540 is provided below the bottom wall portion 61. The cartridge attaching portion 60 is provided with a recessed space surrounded by these five wall portions, and the plurality of ink cartridges 20 and the holder unit 30 can be attached in this recessed space from above (+Z direction).

Hereinafter, in this specification, a multiple unit constituted by the holder unit 30 holding the plurality of ink cartridges 20 will be called an ink supply system 10 (liquid supply system). In the ink supply system 10, the holder unit 30 that is arranged so as to cover the plurality of ink cartridges 20 is engaged with the cartridge attaching portion 60, thereby fixing the plurality of ink cartridges 20 to the carriage unit 520. Ink can thereby be supplied from the ink cartridges 20 each serving as an ink supply unit (liquid supply unit) to the print head 540. Note that the XYZ directions shown in the drawings in this specification indicate the XYZ directions in a state where the ink supply system 10 is attached to the carriage unit 520 of the printer 500 installed on an XY plane as shown in FIG. 1.

Ink Cartridge

Each ink cartridge 20 contains ink, which serves as a printing material. The printer 500 according to Embodiment 1 discharges, from the print head 540, ink of six colors, namely black, yellow, magenta, light magenta, cyan, and light cyan. Accordingly, six ink cartridges 20 can be attached to the cartridge attaching portion 60. Each of six ink cartridges 20 stores ink of a corresponding one of the aforementioned six colors. Note that the number and the type of ink cartridges that can be attached to the cartridge attaching portion 60 are not limited to the aforementioned number and type, and can be changed as appropriate.

Figure 2A:
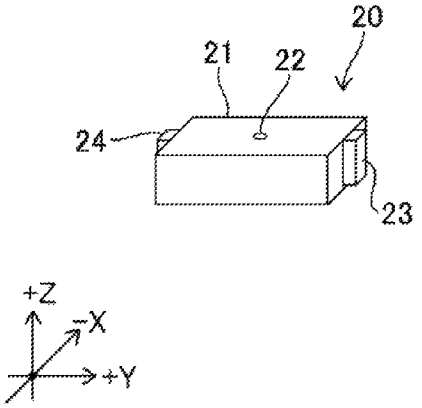
FIGS. 2A and 2B are perspective views schematically showing an ink cartridge.
Figure 2B:
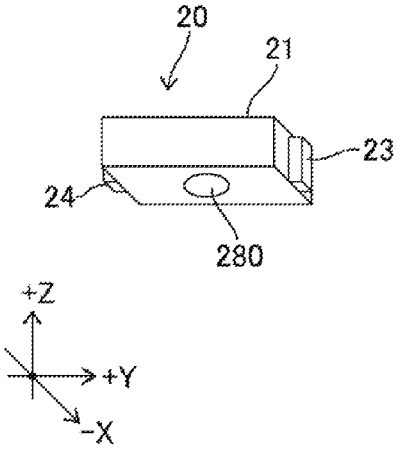

FIGS. 2A and 2B are perspective views schematically showing the ink cartridge 20. FIG. 2A is a perspective view as viewed obliquely from above, and FIG. 2B is a perspective view as viewed obliquely from below. The ink cartridge 20 includes a rectangular parallelepiped housing 21, an ink supply portion 280, an atmosphere communication port 22, a front projection portion 23, and a rear projection portion 24. An ink containing portion that contains ink is provided within the housing 21, and a porous ink holding member 284 (see FIG. 4D) is arranged therein. The ink supply portion 280 is provided in a bottom portion of the housing 21, and the atmosphere communication port 22 is open in an upper face of the housing 21. The ink supply portion 280 and the atmosphere communication port 22 are in communication with the ink containing portion.

The front projection portion 23 projects in the +Y direction from a side face (front face) of the housing that is oriented in the +Y direction. The rear projection portion 24 projects in the −Y direction from a side face (back face) of the housing 21 that is oriented in the −Y direction. The front projection portion 23 and the rear projection portion 24 each have a rib-like form extending in the Z direction along a side face of the housing 21, and have a fixed dimension of projection from the side face of the housing 21 and a fixed width in the X direction.

Holder Unit

Figure 3A:
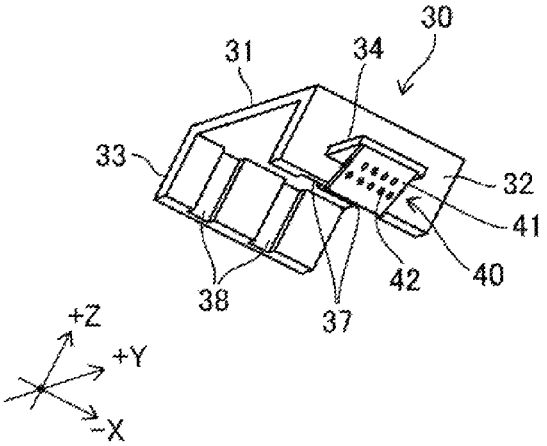
FIGS. 3A and 3B are perspective views schematically showing a holder unit.
Figure 3B:
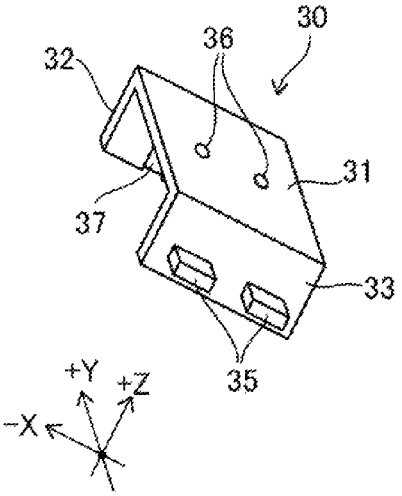

FIGS. 3A and 3B are perspective views schematically showing the holder unit 30. FIG. 3A is a perspective view as viewed obliquely from below, and FIG. 3B is a perspective view as viewed obliquely from above. As mentioned above, Embodiment 1 provides the configuration in which the six ink cartridges 20 are held by a single holder unit 30 and fixed to the carriage unit 520, but FIGS. 3A and 3B show a simplified configuration in which two ink cartridges 20 are held for the purpose of simplification of the description.

The holder unit 30 includes an upper wall portion 31 that covers, from the side in the +Z direction, the two ink cartridges 20 arranged side-by-side in the X direction serving as the main scanning direction, a front wall portion 32 that is continuous with an end portion of the upper wall portion 31 in the +Y direction, and a rear wall portion 33 that is continuous with an end portion of the upper wall portion 31 in the −Y direction. The holder unit 30 houses and holds the two ink cartridges 20 in a space surrounded by these three wall portions. The holder unit 30 also includes a first engaging projection portion 34, two second engaging projection portions 35, two atmosphere release openings 36, two front recess portions 37, two rear recess portions 38, and a terminal portion 40.

The first engaging projection portion 34 projects in the +Y direction from the front wall portion 32 of the holder unit 30. The two second engaging projection portions 35 are arranged side-by-side in the X direction, while projecting in the −Y direction from the rear wall portion 33. The terminal portion 40 includes a circuit board 41 arranged obliquely between a leading end of the first engaging projection portion 34 and a lower end of the front wall portion 32, and a terminal group 42 placed on the circuit board 41. The terminal group 42 includes contact portions arrayed on a surface of the circuit board 41. A storage element is provided on the back side of the circuit board 41. Information regarding the ink in the ink cartridges 20 (amount of ink, ink color, etc.) is stored in the storage element. The terminal group 42 is electrically connected to the storage element.

Atmosphere release openings 36 are formed in the upper wall portion 31. The two atmosphere release openings 36, which are arranged side-by-side in the X direction, are through holes penetrating the upper wall portion 31. The front wall portion 32 and the rear wall portion 33 are opposed to each other in the Y direction, and two pairs of recess portions are formed in opposing faces of these wall portions. That is to say, the two front recess portions 37 are formed in the front wall portion 32 while being arranged side-by-side in the X direction, and the two rear recess portions 38 are formed in the rear wall portion 33 while being arranged side-by-side in the X direction. These four recess portions each have a groove shape having a fixed width and a fixed depth, and extend in the Z direction. The two front recess portions 37 are opposed to the rear recess portions 38 in the Y direction.

Attaching of ink supply system to cartridge attaching portion

Figure 4A:
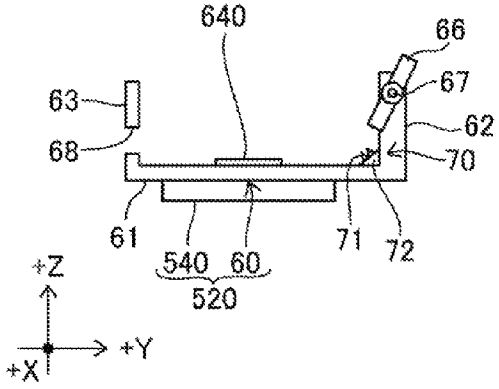
FIGS. 4A to 4D are illustrative diagrams schematically showing a cross-sectional configuration of a carriage unit and an ink supply system.
Figure 4B:
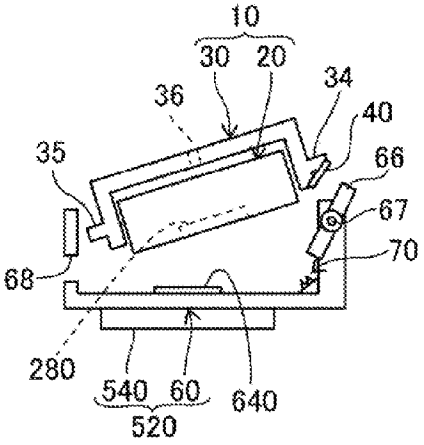
Figure 4C:
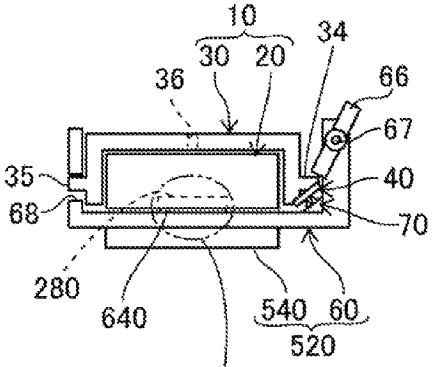
Figure 4D:
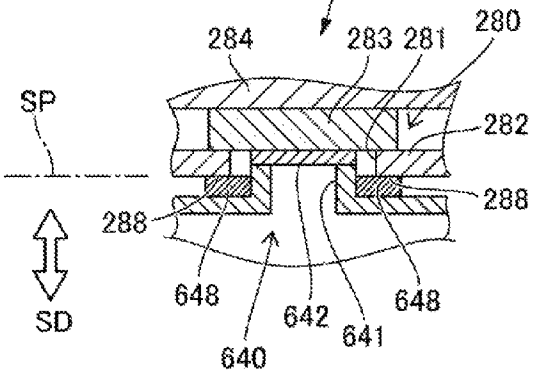
Figure 5C:
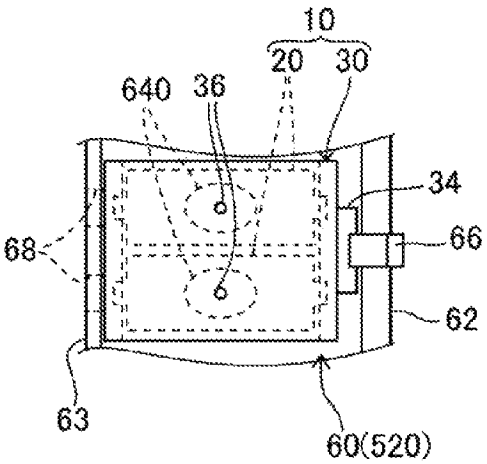
FIGS. 5A to 5C are illustrative diagrams schematically showing a plan configuration of the carriage unit and the ink supply system.
Figure 5B:
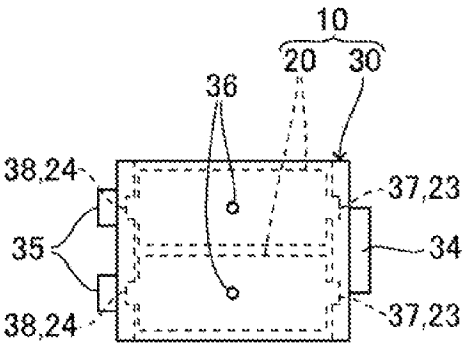
Figure 5A:
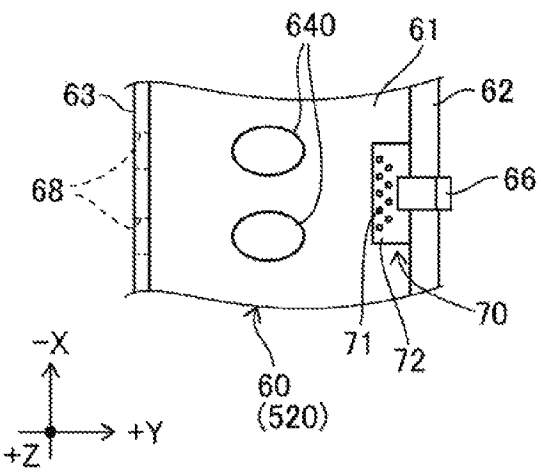

FIGS. 4A to 4D are illustrative diagrams schematically showing a cross-sectional configuration of the carriage unit 520 and the ink supply system 10, and FIGS. 5A to 5C are illustrative diagrams schematically showing a plan configuration of the carriage unit 520 and the ink supply system 10. Note that FIGS. 5A to 5C show a simplified configuration in which not six, but two ink cartridges 20 containing different ink are held by a single holder unit 30, as in FIGS. 3A and 3B.

FIGS. 4A and 5A are a cross-sectional view and a plan view, respectively, that schematically show the carriage unit 520. The cartridge attaching portion 60 in the carriage unit 520 is provided with a plurality of ink introduction portions 640, a contact point mechanism 70, a first engaging portion 66, and two second engaging portions 68. The ink introduction portions 640 project in the +Z direction from the bottom wall portion 61, as shown in FIG. 4A. The same number of ink introduction portions 640 as the number of ink cartridges 20 to be attached to the cartridge attaching portion 60 are arranged on the bottom wall portion 61 side-by-side in the X direction. The adjacent ink introduction portions 640 are partitioned by a rib (not shown). Regions demarcated in the X direction by the rib are each a cartridge attachment slot that includes a single ink introduction portion 640.

The contact point mechanism 70 includes a terminal group 71 in which a plurality of terminals are arranged, and a terminal base 72 that holds the terminal group 71. The terminal base 72 has an inclined face that inclines relative to the bottom wall portion 61 and the first side wall portion 62, and contact portions of the terminals constituting the terminal group 71 are arranged on the inclined face. The terminal group 71 is biased in the direction in which the contact portions of the terminals project from the inclined face 73. When the holder unit 30 is engaged with the cartridge attaching portion 60, the contact portions of the terminal group 71 elastically come into contact with the contact portions of the terminal group 42 provided in the holder unit 30.

The first engaging portion 66, which can move relative to the first side wall portion 62, is provided in the first side wall portion 62. The first engaging portion 66 according to Embodiment 1 is a rotary lever, and can rotate around an axis extending in the X direction with a rotation fulcrum 67 provided in an upper part of the first side wall portion 62 as the center. This first engaging portion 66 is a portion that is to engage with the first engaging projection portion 34 of the above-described holder unit 30. Meanwhile, the two engaging portions 68 are formed in the second side wall portion 63. The second engaging portions 68 are pass-through portions that passes through the second side wall portion 63 in the Y direction, and are arranged side-by-side in the X direction. The second engaging portions 68 can engage with the second engaging projection portions 35 of the above-described holder unit 30. Note that the second engaging portions 68 do not need to be pass-through portions. For example, the second engaging portions 68 may be recess portions.

FIG. 5B is a plan view of the ink supply system 10 as viewed from above. In the ink supply system 10, the two ink cartridges 20 arranged side-by-side in the X direction are held by the holder unit 30. Of each of the two ink cartridges 20, the front projection portion 23 engages with the corresponding front recess portion 37 of the holder unit 30, and the rear projection portion 24 engages with the corresponding rear recess portion 38 of the holder unit 30. The front projection portion 23 and the rear projection portion 24 each function as a first restriction portion that restricts movement of the ink cartridge 20 in the X direction, which is the main scanning direction, by engaging with the holder unit 30. In addition, the atmosphere communication ports 22 of the two ink cartridges 20 overlap, in the Z direction, the two atmosphere release openings 36 on the side of the holder unit 30. Note that the number and the shape of the first restriction portions (front projection portion 23, rear projection portion 24) are not limited to the aforementioned number and shape. For example, the projections may be replaced with recesses.

FIG. 4B shows a state in the middle of attaching the ink supply system 10 to the cartridge attaching portion 60. When attaching the ink supply system 10 to the cartridge attaching portion 60, a rear end portion (end portion in the −Y direction) of the holder unit 30 is lowered in the −Z direction relative to a front end portion (end portion in the +Y direction) of the holder unit 30, and the two second engaging projection portions 35 are inserted into the second engaging portions 68 of the cartridge attaching portion 60 to engage therewith. Thereafter, the front end portion (end portion in the +Y direction) of the holder unit 30 is lowered, the first engaging portion 66 of a rotary type is rotated, and the first engaging projection portion 34 is engaged with the first engaging portion 66. Thereby, the attaching of the ink supply system 10 to the cartridge attaching portion 60 is complete as shown in FIGS. 4C and 5C.

In the state where the attaching is complete as shown in FIGS. 4C and 5C, movement of the ink cartridges 20 in the +Z direction is restricted by the holder unit 30, and the ink cartridges 20 are fixed to the cartridge attachment slots. The first engaging portion 66 is biased in the −Z direction by a biasing portion (not shown). Otherwise, the ink cartridge 20 is biased in the +Z direction from the bottom wall portion 61 of the cartridge attaching portion 60 by a biasing portion (not shown), and the first engaging projection portion 34 of the holder unit 30 is biased in the +Z direction toward the first engaging portion 66. For this reason, the engaging state between the first engaging projection portion 34 and the first engaging portion 66 is stable. Accordingly, the state of the holder unit 30 fixing the ink cartridges 20 in the Z direction is stable. In addition, as mentioned above, the front projection portion 23 and the rear projection portion (first restriction portion) of each ink cartridge 20 engage with the recess portions (front recess portion 37, rear recess portion 38) of the holder unit 30 to position the ink cartridge 20 in the X direction (main scanning direction). Furthermore, the front wall portion 32 and the rear wall portion 33 of the holder unit 30 position the ink cartridge 20 in the Y direction (direction orthogonal to the main scanning direction).

As shown in FIG. 4C, in a state where the ink supply system 10 is attached to the cartridge attaching portion 60, the ink supply portion 280 of each ink cartridge 20 is opposed, in the Z direction, to the corresponding ink introduction portion 640 of the cartridge attaching portion 60, and the ink supply portion 280 is connected to the ink introduction portion 640. The ink in the ink cartridge 20 can thereby be introduced to the ink introduction portion 640 via the ink supply portion 280. In this state, the contact portions of the terminal group 71 provided in the contact point mechanism 70 elastically come into contact with the contact portions of the terminal group 42 provided in the terminal portion 40 on the side of the ink cartridge 20. Thereby, the terminal portion 40 on the side of the ink supply system 10 is electrically connected to the contact point mechanism 70 on the side of the carriage unit 520.

FIG. 4D is an enlarged view of a connecting portion of the ink supply portion 280 and the ink introduction portion 640. The ink supply portion 280 includes an ink supply port 281 and an outer wall 282 that surrounds the ink supply port 281. The outer wall 282 includes an opening face 288 that is oriented in the −Z direction. An ink supply port constituting member 283 is arranged at the ink supply port 281. The ink supply port constituting member 283 is a fibrous member formed by bundling polypropylene or the like that is drawn and made fibrous, or a porous member formed by a foam body such as polyurethane. The ink supply port constituting member 283 is in contact with the ink holding member 284 arranged in the +Z direction relative thereto.

The ink introduction portion 640 includes a tubular ink introduction port 641, and a seal portion 648 that surrounds the ink introduction port 641. The seal portion 648 can undergo elastic deformation in the Z direction. A mesh filter 642 is attached to a leading end in the +Z direction of the ink introduction port 641. The opening face 288 of the ink supply portion 280 elastically comes into contact with the seal portion 648 and sticks thereto. Thereby, the periphery of the ink supply port 281 and the ink introduction port 641 is tightly closed, preventing leakage of the ink. At this time, the mesh filter 642 comes into surface contact with the ink supply port constituting member 283 while being pressed thereagainst. Thereby, the ink supply port constituting member 283 is connected to the ink introduction port 641.

In this specification, assuming that a plane in which the ink supply portion 280 of each ink cartridge 20 abuts against the corresponding ink introduction portion 640 of the cartridge attaching portion 60 is a reference plane SP, and a direction in which the ink supply portion 280 abuts against the ink introduction portion 640 is an attaching direction SD, the attaching direction SD is a direction perpendicular to the reference plane SP. As mentioned above, since the opening face 288 of the ink supply portion 280 abuts against the seal portion 648 of the ink introduction portion 640, the reference plane SP corresponds to the opening face 288. When the printer 500 is in use, the opening face 288 corresponds to an XY plane, and accordingly, the reference plane SP is an XY plane and the attaching direction SD is the Z direction.

As mentioned above, FIGS. 3A, 3B, and 5A to 5C simplify the holder unit 30 and show the mode in which the two ink cartridges 20 are held thereby. However, in the case of holding four more ink cartridges 20 as shown in FIG. 1, the dimension of the upper wall portion 31 of the holder unit 30 in the X direction is set so as to be able to cover the six ink cartridges 20, and six atmosphere release openings 36 are provided at positions overlapping six atmosphere communication ports 22 on the ink cartridge side. Then, six pairs of the front recess portion 37 and the rear recess portion 38, which are opposed to each other, are provided respectively in the front wall portions 32 and the rear wall portions 33.

Note that the number of ink cartridges 20 to be held by the holder unit 30 may be any number that is 2 or greater. For example, six ink cartridges 20 can be attached to the cartridge attaching portion 60 using three holder units 30 each of which holds two ink cartridges 20 as shown in FIGS. 3A, 3B, and 5A to 5C, or using two holder units 30 each of which holds three ink cartridges 20.

As described above, with the ink supply system 10 according to Embodiment 1, at least two ink cartridges 20 can be fixed to the cartridge attaching portion 60 using a single holder unit 30. Accordingly, a plurality of ink cartridges 20 do not need to be individually engaged with the cartridge attaching portion 60, and a replacement operation can be easily performed. In addition, an engagement structure does not need to be provided for each ink cartridge 20, and furthermore, and a terminal portion does not need to be provided in each ink cartridge 20 since the holder unit 30 has the terminal portion 40. Accordingly, the structure of the ink cartridges 20 and the cartridge attaching portion 60 can be simplified, which is advantageous for a size reduction. In addition, the plurality of ink cartridges 20, which are separate bodies, can be independently replaced. Accordingly, the ink cartridges do not need to be replaced while some ink remains as in the case of an integrated ink cartridge, and waste of ink can be reduced.

In Embodiment 1, when the plurality of ink cartridges 20 are attached to the holder unit 30, the atmosphere communication port 22 of each ink cartridge 20 overlaps the corresponding atmosphere release opening 36 of the holder unit 30. Accordingly, the atmosphere communication port 22 is not blocked by the holder unit 30, and a state where the ink cartridge 20 is in communication with the atmosphere can be maintained.

In Embodiment 1, the movement of the ink cartridges 20 in the X direction that is the main scanning direction can be restricted by engaging the recess portions (front recess portion 37, rear recess portion 38) of the holder unit 30 with the projection portions (front projection portion 23, rear projection portion 24) of the ink cartridges 20. Accordingly, the ink cartridge 20 can be positioned in the X direction. Note that a similar effect can also be obtained with a configuration in which the holder unit 30 is provided with projection portions and each ink cartridge 20 is provided with recess portions.

Embodiment 2

Figure 6A:
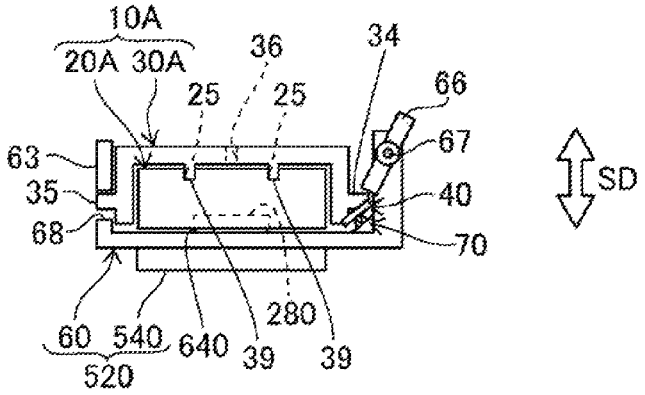
FIGS. 6A to 6C are illustrative diagrams schematically showing an ink supply system according to Embodiment 2.
Figure 6B:
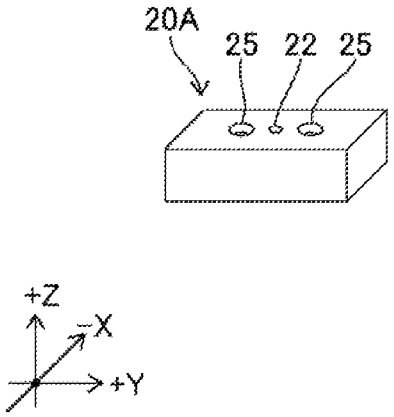
Figure 6C:
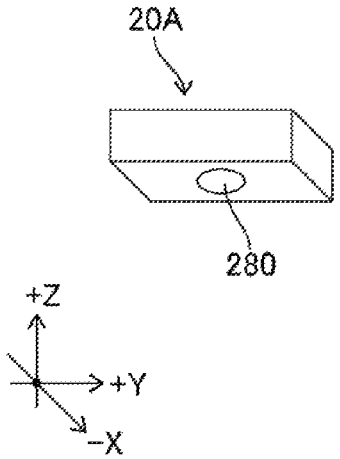

FIGS. 6A to 6C are illustrative diagrams schematically showing an ink supply system 10A according to Embodiment 2. FIG. 6A is a cross-sectional view schematically showing a state where the ink supply system 10A is attached to a carriage unit 520, FIG. 6B is a perspective view showing an ink cartridge 20A as viewed obliquely from above, and FIG. 6C is a perspective view of the ink cartridge 20A as viewed obliquely from below. Hereinafter, the same part as that of the already-described mode will be assigned the same signs and descriptions thereof will be omitted. Only different part will be assigned different signs and will be described. Embodiment is different from Embodiment 1 in the mode of the restriction portion for restricting movement of the ink cartridge 20A when a plurality of ink cartridges 20A are held by a holder unit 30A.

The ink supply system 10A according to Embodiment 2 includes a plurality of ink cartridges 20A, and a holder unit 30A that fixes the ink cartridges 20A to a cartridge attaching portion 60. As shown in FIG. 6B, each ink cartridge 20A does not have a front projection portion 23 and a rear projection portion 24 formed on side faces of a housing 21 as in Embodiment 1. Instead, two upper recess portions 25 and 26 are formed in a face (upper face) of the housing 21 that is oriented in the +Z direction. The two upper recess portions 25 are arranged on the sides of an atmosphere communication port 22 in the +Y direction and the −Y direction.

The holder unit 30A is not provided with front recess portions 37 in a front wall portion 32 as in Embodiment 1, and is not provided with rear recess portions 38 in a rear wall portion 33 as in Embodiment 1. Instead, the holder unit 30A includes upper projection portions 39 that project downward (−Z direction) from the upper wall portion 31. A total of four upper projecting portions 39 are provided. Namely, two upper projection portions 39 are provided on the sides of each of the two atmosphere release openings 36 in the +Y direction and the −Y direction.

Here, it is assumed, as in Embodiment 1, that a direction perpendicular to an abutting face (opening face 288: XY plane) in which an ink supply portion 280 of each ink cartridge 20A abuts against a corresponding ink introduction portion 640 of the holder unit 30A is an attaching direction SD (Z direction), and, of the attaching direction SD, a direction that extends from the ink introduction portion 640 toward the ink supply portion 280 (i.e., the direction in which the ink cartridge 20A is detached: +Z direction) is a first direction, and a direction that extends from the ink supply portion 280 toward the ink introduction portion 640 (i.e., the direction in which the ink cartridge 20A is attached: −Z direction) is a second direction. At this time, the upper projection portions 39 project while being oriented in the second direction (−Z direction) from the upper wall portion 31 of the holder unit 30A.

As shown in FIG. 6A, when the plurality of ink cartridges 20A are held by the holder unit 30A, the upper projection portions 39 of the holder unit 30A engage with the two upper recess portions 25 of each ink cartridge 20A. Thereby, the ink cartridge 20A can be positioned in the X direction and the Y direction.

As described above, with the ink supply system 10A according to Embodiment 2, the configuration similar to that in Embodiment 1 achieves an effect similar to that of Embodiment 1. In addition, each ink cartridge 20A includes recess portions (upper recess portions 25) each serving as a first restriction portion that restricts movement of the ink cartridge 20A in the X direction that is the main scanning direction of the carriage unit 520, and the direction (Y direction) that intersects the attaching direction SD (Z direction) when the ink cartridge 20A is held by the holder unit 30A to constitute the ink supply system 10A. Accordingly, when the plurality of ink cartridges 20A are fixed to the carriage unit 520 using the holder unit 30A, movement of each ink cartridge 20A in the main scanning direction (X direction) and the direction (Y direction) that intersects the attaching direction SD (Z direction) can be restricted, and the ink cartridge 20A can be positioned in these directions.

Note that the number and the shape of first restriction portion according to Embodiment 2 are not limited to the aforementioned number and shape. For example, the recess of the first restriction portion according to Embodiment 2 may be replaced with projection. That is to say, recess portions may be formed in place of the upper projection portions 39, and projection portions may be formed in place of the upper recess portions 25.

Embodiment 3

Figure 7C:
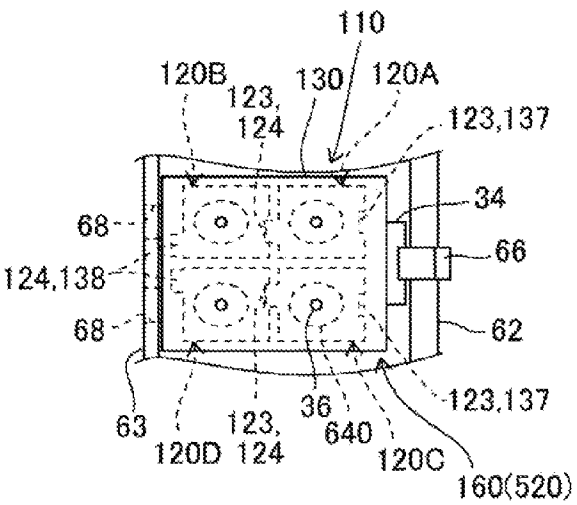
FIGS. 7A to 7C are illustrative diagrams schematically showing an ink supply system according to Embodiment 3.
Figure 7B:
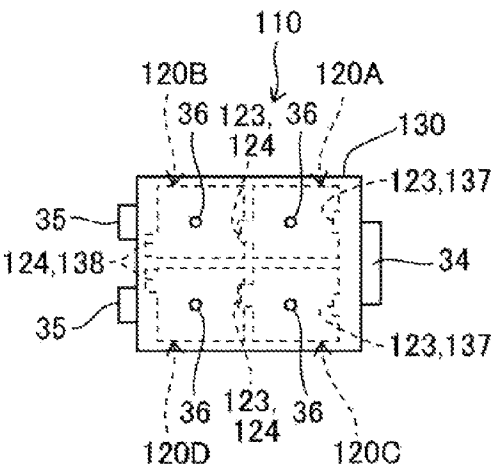
Figure 7A:
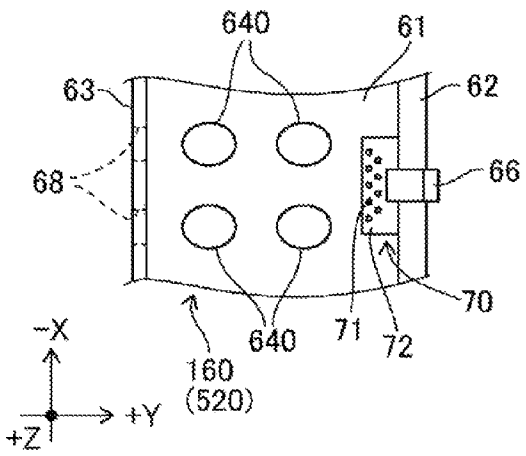

FIGS. 7A to 7C are illustrative diagrams schematically showing an ink supply system 110 according to Embodiment 3. FIG. 7A is a plan view of a carriage unit 520, FIG. 7B is a plan view of the ink supply system 110, and FIG. 7C is a plan view showing a state where the ink supply system 110 is attached to a cartridge attaching portion 160 of the carriage unit 520. The ink supply system 110 according to Embodiment 3 includes four ink cartridges 120A, 120B, 120C, and 120D, and a holder unit 130.

The cartridge attaching portion 160 according to Embodiment 3 is provided with ink introduction portions 640, a contact point mechanism 70, a first engaging portion 66, and two second engaging portions 68. The cartridge attaching portion 160 is configured similarly to the cartridge attaching portion 60 according to Embodiment 1 except the arrangement of the ink introduction portions 640. In the cartridge attaching portion 160, four ink introduction portions 640 are arranged in 2×2 lines, and a total of four cartridge attachment slots are provided.

As shown in FIG. 7B, the ink cartridges 120A, 120B, 120C, and 120D are arranged in 2×2 lines so as to correspond to the arrangement of the ink introduction portions 640. The ink cartridges 120A and 120B constitute a line of the 2×2 lines on the side in the −X direction, and are located respectively on the sides in the +Y direction and the −Y direction. The ink cartridges 120C and 120D constitute a line of the 2×2 lines on the side in the +X direction, and are located respectively on the sides in the +Y direction and the −Y direction. The four ink cartridges 120A, 120B, 120C, and 120D each include a rectangular parallelepiped housing. An ink supply portion 280 is provided in a bottom portion of each housing, and an atmosphere communication port 22 is open in an upper face of each housing. A front recess portion 123 is formed in a side face of each housing in the +Y direction, and a rear projection portion 124 is formed in a side face of each housing in the −Y direction.

As shown in FIG. 7B, the positions of the front recess portions 123 and the rear projection portions 124 in the X direction are different among the four ink cartridges 120A, 120B, 120C, and 120D. Regarding the ink cartridges that are adjacent in the Y direction (i.e., the ink cartridges 120A and 120B, and the ink cartridges 120C and 120D), the positions of the front recess portions 123 and the rear projection portions 124 are determined such that the rear projection portion 124 of the ink cartridge 120A engages with the front recess portion 123 of the ink cartridge 120B, and the rear projection portion 124 of the ink cartridge 120C engages with the front recess portion 123 of the ink cartridge 120D.

The holder unit 130 includes four atmosphere release openings 36, two front projection portions 137, two rear recess portions 138, and a terminal portion 40. The atmosphere release openings 36 are formed at positions overlapping the atmosphere communication ports 22 of the four ink cartridges 120A, 120B, 120C, and 120D. The front projection portions 137 are formed such that the position and the shape thereof enable the front projection portions 137 to engage with the front recess portions 123 of the ink cartridges 120A and 120C. The rear recess portions 138 are formed such that the position and the shape thereof enable the rear recess portions 138 to engage with the rear projection portions 124 of the ink cartridges 120B and 120D.

The holder unit 130 also includes a first engaging projection portion 34 and two second engaging projection portions 35. These engaging projection portions are engaged with the first engaging portion 66 and the two second engaging portions 68 of the cartridge attaching portion 160, and the attaching of the holder unit 130 is thereby complete as shown in FIG. 7C.

The front recess portion 123 of the ink cartridge 120A is a first restriction portion that engages with the corresponding front projection portion 137 of the holder unit 130 and restricts movement of the ink cartridge 120A in the X direction that is the main scanning direction. The front recess portion 123 of the ink cartridge 120B is a second restriction portion that engages with the rear projection portion 124 of the ink cartridge 120A and restricts movement of the ink cartridge 120B in the X direction that is the main scanning direction. The rear recess portions 138 of the holder unit 130 are third restriction portions, one of which engages with the rear projection portion 124 of the ink cartridge 120B and restricts movement of the ink cartridge 120B in the X direction that is the main scanning direction. Regarding the line of the ink cartridges 120C and 120D, similarly, the ink cartridge 120C includes the front recess portion 123 serving as the first restriction portion, the ink cartridge 120D includes the front recess portion 123 serving as the second restriction portion, and the holder unit 130 includes the corresponding rear recess portion 138 serving as the third restriction portion.

In the state where the attaching is complete as shown in FIG. 7C, movement of the four ink cartridges 120A to 120D in the +Z direction is restricted by the holder unit 130, and the ink cartridges 120A to 120D are fixed to the cartridge attaching portion 160. The ink supply portions 280 of the four ink cartridges 120A to 120D are connected to the four ink introduction portions 640 in one-to-one correspondence. Furthermore, the terminal group 71 provided in the contact point mechanism 70 on the side of the cartridge attaching portion 160 comes into contact with the terminal group 42 provided in the terminal portion 40 on the side of the holder unit 130.

As described above, in the ink supply system 110 according to Embodiment 3, the four ink cartridges 120A to 120D can be covered with the single holder unit 130 and fixed to the cartridge attaching portion 160 as in Embodiments 1 and 2. Accordingly, the ink cartridges 120A to 120D do not need to be individually engaged with the holder unit 130, and a replacement operation can be easily performed. In addition, the structure of the ink cartridges 120A to 120D and the cartridge attaching portion 160 can be simplified, which is advantageous for a size reduction. Furthermore, the ink cartridges do not need to be replaced while some ink remains, and waste of ink can be reduced. In addition, in Embodiment 3, the ink cartridges can restrict movement thereof among them, and accordingly, the configuration of the holder unit 130 can be simplified. Accordingly, Embodiment 3 is more advantageous for a size reduction.

In the ink supply system 110 according to Embodiment 3, the ink cartridge 120A and the ink cartridge 120B are arranged side-by-side in the Y direction orthogonal to the X direction serving as the main scanning direction when these ink cartridges are attached to the carriage unit 520, and the movement of the ink cartridges 120A and 120B in the X direction can be restricted by the above-described first to third restriction portions. Accordingly, even if the force exerted in the main scanning direction (X direction) is applied by sliding of the carriage unit 520, it is unlikely that the positions of the ink cartridges 120A and 120B move in the main scanning direction (X direction). The same applies to the ink cartridges 120C and 120D.

In addition, in the ink supply system 110 according to Embodiment 3, when the front recess portions 123 of the ink cartridges 120A and 120B and the rear recess portion 138 of the holder unit 130 are viewed in a plan view in the Z direction (attaching direction SD), the positions of the front recess portion 123 of the ink cartridge 120A and the front recess portion 123 of the ink cartridge 120B in the main scanning direction (X direction) are different. Accordingly, it is possible to prevent the ink cartridges 120A and 120B from being incorrectly attached. In addition, the positions of the front recess portions 123 and the rear projection portions 124 of the four ink cartridges 120A, 120B, 120C, and 120D in the X direction are different, and accordingly, it is also possible to prevent the ink cartridges 120C and 120D from being incorrectly attached.

Embodiment 4

Figure 8C:
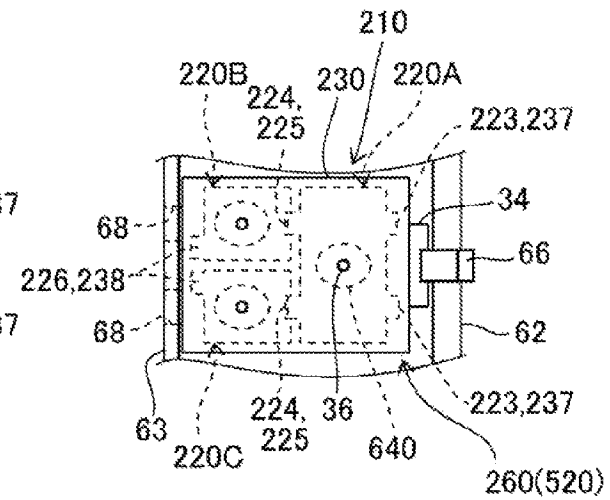
FIGS. 8A to 8C are illustrative diagrams schematically showing an ink supply system according to Embodiment 4.
Figure 8B:
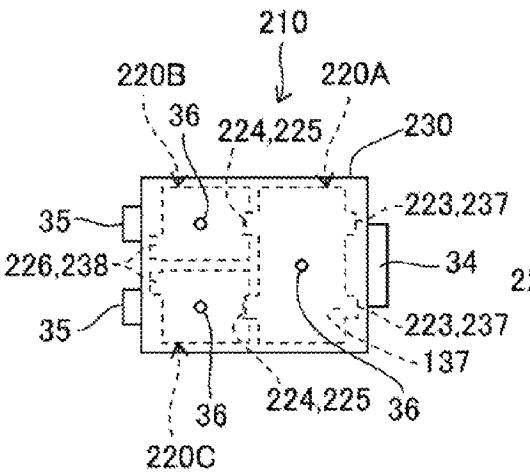
Figure 8A:
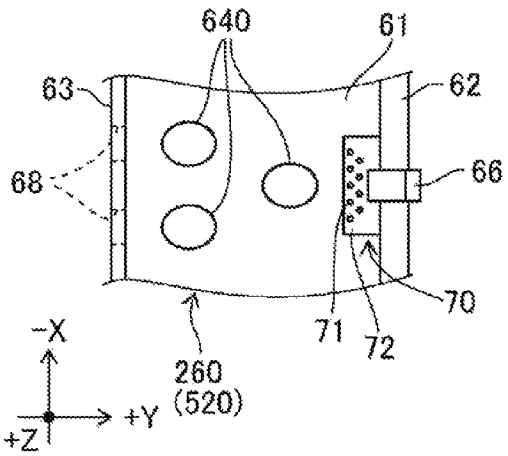

FIGS. 8A to 8C are illustrative diagrams schematically showing an ink supply system 210 according to Embodiment 4. FIG. 8A is a plan view of a carriage unit 520, FIG. 8B is a plan view of the ink supply system 210, and FIG. 8C is a plan view showing a state where the ink supply system 210 is attached to a cartridge attaching portion 260 of the carriage unit 520. The ink supply system 210 according to Embodiment 4 includes three ink cartridges 220A, 220B, and 220C, and a holder unit 230.

The cartridge attaching portion 260 according to Embodiment 4 is provided with ink introduction portions 640, a contact point mechanism 70, a first engaging portion 66, and two second engaging portion 68. The cartridge attaching portion 260 is configured similarly to the cartridge attaching portion 60 according to Embodiment 1 except the arrangement of the ink introduction portions 640. In the cartridge attaching portion 260, one of the three ink introduction portions 640 is arranged on the side in the +Y direction, and the other two ink introduction portions 640 are arranged on the side in the −Y direction.

As shown in FIG. 8B, the ink cartridges 220A, 220B, and 220C are arranged so as to correspond to the arrangement of the ink introduction portions 640. The ink cartridge 220A is located on the side in the +Y direction, and the ink cartridges 220B and 220C are arranged on the side in the −Y direction relative to the ink cartridge 220A, side-by-side in the X direction. That is to say, the ink cartridges 220A and 220B are arranged side-by-side in the Y direction orthogonal to the X direction (main scanning direction), the ink cartridges 220A and 220C are arranged side-by-side in the Y direction orthogonal to the X direction (main scanning direction), and the ink cartridges 220B and 220C are arranged side-by-side in the X direction (main scanning direction). The three ink cartridges 220A, 220B, and 220C each include a rectangular parallelepiped housing. An ink supply portion 280 is provided in a bottom portion of each housing, and an atmosphere communication port 22 is open in an upper face of each housing.

The ink cartridge 220A includes two front projection portions 223 formed in a side face of the housing in the +Y direction, and two rear projection portions 224 formed in a side face of the housing in the −Y direction. The ink cartridges 220B and 220C have the same shape, and each include a front recess portion 225 formed in a side face of the housing in the +Y direction, and a rear projection portion 226 formed in a side face of the housing in the −Y direction. The positions of the front recess portions 225 and the rear projection portions 226 in the X direction are different between the two ink cartridges 220B and 220C. The rear projection portions 224 of the ink cartridge 220A are formed such that the position and the shape thereof enable the rear projection portions 224 to engage with the front recess portions 225 of the ink cartridges 220B and 220C.

The holder unit 230 includes three atmosphere release openings 36, two front recess portions 237, two rear recess portions 238, and a terminal portion 40. The atmosphere release openings 36 are formed at positions overlapping the atmosphere communication ports 22 of the three ink cartridges 220A, 220B, and 220C. The front recess portions 237 are formed such that the position and the shape thereof enable the front recess portions 237 to engage with the front projection portions 223 of the ink cartridge 220A. The rear recess portions 238 are formed such that the position and the shape thereof enable the rear recess portions 238 to engage with the rear projection portions 226 of the ink cartridges 220B and 220C.

The holder unit 230 also includes a first engaging projection portion 34 and two second engaging projection portions 35. These engaging projection portions are engaged with the first engaging portion 66 and the two second engaging portions 68 of the cartridge attaching portion 260, and the attaching of the holder unit 230 is thereby complete as shown in FIG. 8C.

The front projection portions 223 of the ink cartridge 220A are first restriction portions that engage with the front recess portions 237 of the holder unit 230 and restrict movement of the ink cartridge 220A in the X direction that is the main scanning direction. The front recess portions 225 of the ink cartridges 220B and 220C are second restriction portions that engage with the rear projection portions 224 of the ink cartridge 220A and restrict movement of the ink cartridges 220B and 220C in the X direction that is the main scanning direction. The rear recess portions 238 of the holder unit 230 are third restriction portions that engage with the rear projection portions 226 of the ink cartridges 220B and 220C and restrict movement of the ink cartridges 220B and 220C in the X direction that is the main scanning direction.

In the state where the attaching is complete as shown in FIG. 8C, movement of the three ink cartridges 220A to 220C in the +Z direction is restricted by the holder unit 230, and the ink cartridges 220A to 220C are fixed to the cartridge attaching portion 260. The ink supply portions 280 of the three ink cartridges 220A to 220C are connected to the three ink introduction portions 640 in one-to-one correspondence. Furthermore, the terminal group 71 provided in the contact point mechanism 70 on the side of the cartridge attaching portion 260 comes into contact with the terminal group 42 provided in the terminal portion 40 on the side of the holder unit 130.

As described above, in the ink supply system 210 according to Embodiment 4, the three ink cartridges 220A to 220C can be fixed to the cartridge attaching portion 260 using a single holder unit 230 as in Embodiments 1 to 3. Accordingly, the ink cartridges 220A to 220C do not need to be individually engaged with the cartridge attaching portion 260, and a replacement operation can be easily performed. In addition, the structure of the ink cartridges 220A to 220C and the cartridge attaching portion 260 can be simplified, which is advantageous for a size reduction. Furthermore, the ink cartridges do not need to be replaced while some ink remains, and waste of ink can be reduced.

In the ink supply system 210 according to Embodiment 4, two of the three ink cartridges 220A to 220C are arranged adjacent to each other in the X direction, and the remaining one is laterally arranged on the side in the +Y direction. With this configuration, the three ink cartridges 220A to 220C can be arranged in a space-saving manner, and an efficient arrangement can be achieved. In addition, the ink cartridges can restrict movement thereof among them as in Embodiment 3, and accordingly, the configuration of the holder unit 230 can be simplified. Accordingly, Embodiment 4 is advantageous for a size reduction.

In the ink supply system 210 according to Embodiment 4, when forming recess portions and projection portions as the restriction portions in the ink cartridges 220A to 220C, in the case of forming recess portions as the restriction portions, these recess portions are formed in a side face on the short side, which is a face separate from the corresponding ink supply portion 280. Specifically, the front recess portions 225 serving as the second restriction portions are formed in the faces of the ink cartridges 220B and 220C in the +Y direction that are the short sides, at a portion where the ink cartridges 220A and 220B engage with each other and at a portion where the ink cartridges 220A and 220C engage with each other, and the rear projection portions 224 that engage with the front recess portions 225 are formed in the face of the ink cartridge 220A on the side in the −Y direction that is the long side. Thus forming the recesses and projections at positions separate from the ink supply portions 280 can reduce influence on an ink flow within the ink cartridges, which is also advantageous.

Embodiment 5

Figure 9:
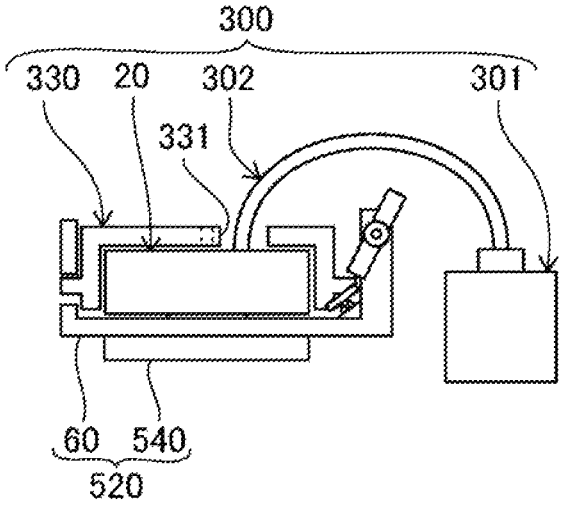
FIG. 9 is an illustrative diagram schematically showing an ink supply system according to Embodiment 5.

FIG. 9 is an illustrative diagram schematically showing an ink supply system 300 according to Embodiment 5. The ink supply system 300, which serves as a liquid supply system, includes a plurality of ink cartridges 20, a holder unit 330, a plurality of external tanks 301 (liquid containers) that contain ink, and a plurality of flexible tubes 302 (first liquid supply tubes) connecting the plurality of ink cartridges 20 to the plurality of external tanks 301 in one-to-one correspondence. The external tanks 301 are installed outside the printer 500. For example, a stationary tank holder may be installed outside the printer 500, and the external tanks 301 may be set in this tank holder. The flexible tubes 302 are connected to the ink cartridges 20 through an opening 331 provided in an upper face of the holder unit 330.

In the ink supply system 300, ink in the external tanks 301 can be supplied to the corresponding ink cartridges 20 via the flexible tubes 302. Accordingly, by fixing the ink cartridges 20 in the ink supply system 300 to the cartridge attaching portion 60 in the printer 500 using the holder unit 330, it is possible to supply the ink in the external tanks 301 to the ink introduction portions 640 in the cartridge attaching portion 60 via the ink cartridges 20 and perform printing with the printer 500. In this mode, the ink cartridges 20 do not need to be replaced when ink runs short, and the external tanks 301 need only be replaced, or the ink need only be supplied to the external tanks 301. Accordingly, the size of the ink cartridges 20 can be reduced. Note that some of the plurality of ink cartridges 20 can be connected to the external tanks 301 using the flexible tubes 302.

OTHER MODES

The configurations in the above-described modes may be combined as appropriate in accordance with the purpose or usage. The invention is applicable not only to inkjet printers and ink cartridges thereof, but also to various liquid ejection apparatuses that eject various kinds of liquid including ink and liquid supply systems to be attached to and detached from carriage units of the liquid ejection apparatuses. For example, the invention is applicable to image forming apparatuses such as facsimiles. Here, ink includes general water-based ink and oil-based ink, as well as various liquid compositions such as gel ink and hot melt-ink. The invention is also applicable to liquid supply systems used in apparatuses that eject color materials used in manufacturing of color filters, apparatuses that eject electrode materials, apparatuses that eject various samples, apparatuses that eject lubricating oil, apparatuses that eject resin liquid, apparatus that eject etching liquid, and the like.

The entire disclosure of Japanese Patent Application No. 2014-243732 filed on Dec. 2, 2014, is expressly incorporated by reference herein.

What is claimed is:

1. A liquid supply system adapted to be mounted in a carriage unit having a first liquid introduction portion and a second liquid introduction portion, the liquid supply system comprising:

a first liquid supply unit having a first liquid supply portion adapted to supply first liquid to the first liquid introduction portion and adapted to be attached to and detached from the carriage unit;

a second liquid supply unit having a second liquid supply portion adapted to supply second liquid to the second liquid introduction portion and adapted to be attached to and detached from the carriage unit independently of the first liquid supply unit; and a holder unit adapted to be attached to and detached from the carriage unit, the holder unit having a first engaging portion and a second engaging portion configured to engage with the carriage unit and adapted to fix the first liquid supply unit and the second liquid supply unit to the carriage unit, wherein when the first liquid supply unit, the second liquid supply unit, and the holder unit are attached to the carriage unit, the first liquid supply unit and the second liquid supply unit are located between the holder unit and the carriage unit, and the first engaging portion and the second engaging portion of the holder unit engage with the carriage unit to fix the first liquid supply unit and the second liquid supply unit to the carriage unit.

2. A liquid supply system according to claim 1, wherein the holder unit has a terminal portion adapted to be electrically connected to the carriage unit.

3. The liquid supply system according to claim 2, wherein when a direction in which the carriage unit scans is defined as a main scanning direction, the first liquid supply unit has a first restriction portion adapted to restrict movement in the main scanning direction with respect to the holder unit when the first liquid supply unit is attached to the carriage unit.

4. The liquid supply system according to claim 2, wherein when a direction in which the carriage unit scans is defined as a main scanning direction, the first liquid supply unit has a first restriction portion adapted to restrict movement in a direction intersecting the attaching direction and the main scanning direction with respect to the holder unit when the first liquid supply unit is attached to the carriage unit.

5. The liquid supply system according to claim 2, wherein when a direction in which the carriage unit scans is defined as a main scanning direction, the first liquid supply unit and the second liquid supply unit are configured to be arranged side-by-side in a direction orthogonal to the main scanning direction when the first liquid supply unit and the second liquid supply unit are attached to the carriage unit, the first liquid supply unit has a first restriction portion adapted to restrict movement in the main scanning direction with respect to the holder unit when the first liquid supply unit is attached to the carriage unit, the second liquid supply unit has a second restriction portion adapted to restrict movement in the main scanning direction with respect to the first liquid supply unit when the second liquid supply unit is attached to the carriage unit, and the holder unit has a third restriction portion adapted to restrict movement in the main scanning direction with respect to the second liquid supply unit when the second liquid supply unit is attached to the carriage unit.

6. The liquid supply system according to claim 5, wherein when the first restriction portion and the second restriction portion are viewed in a plan view in the attaching direction in a state where the first liquid supply unit and the second liquid supply unit are attached to the carriage unit, positions of the first restriction portion and the second restriction portion in the main scanning direction are different from each other.

7. The liquid supply system according to claim 2, further comprising:

a third liquid supply unit having a third liquid supply portion adapted to supply third liquid to the carriage unit and adapted to be attached to and detached from the carriage unit independently of the first liquid supply unit and the second liquid supply unit, wherein when a direction in which the carriage unit scans is defined as a main scanning direction, the first liquid supply unit and the second liquid supply unit are configured to be arranged side-by-side in a direction orthogonal to the main scanning direction when the first liquid supply unit and the second liquid supply unit are attached to the carriage unit, the first liquid supply unit and the third liquid supply unit are configured to be arranged side-by-side in the direction orthogonal to the main scanning direction when the first liquid supply unit and the third liquid supply unit are attached to the carriage unit, and the second liquid supply unit and the third liquid supply unit are configured to be arranged side-by-side in the main scanning direction when the second liquid supply unit and the third liquid supply unit are attached to the carriage unit.

8. The liquid supply system according to claim 2, further comprising:

a liquid container; and a first liquid supply tube that connects the first liquid supply unit to the liquid container.

9. The liquid supply system according to claim 2, wherein the first liquid supply unit has a first atmosphere communication hole, and the holder unit has a first atmosphere release opening adapted to be in communication with the first atmosphere communication hole.

10. The liquid supply system according to claim 1, wherein the first liquid supply unit has a first atmosphere communication hole, and the holder unit has a first atmosphere release opening adapted to be in communication with the first atmosphere communication hole.

11. The liquid supply system according to claim 1, wherein when a direction in which the carriage unit scans is defined as a main scanning direction, the first liquid supply unit has a first restriction portion adapted to restrict movement in the main scanning direction with respect to the holder unit when the first liquid supply unit is attached to the carriage unit.

12. The liquid supply system according to claim 1, wherein when a direction in which the carriage unit scans is defined as a main scanning direction, the first liquid supply unit has a first restriction portion adapted to restrict movement in a direction intersecting the attaching direction and the main scanning direction with respect to the holder unit when the first liquid supply unit is attached to the carriage unit.

13. The liquid supply system according to claim 1, wherein when a direction in which the carriage unit scans is defined as a main scanning direction, the first liquid supply unit and the second liquid supply unit are configured to be arranged side-by-side in a direction orthogonal to the main scanning direction when the first liquid supply unit and the second liquid supply unit are attached to the carriage unit, the first liquid supply unit has a first restriction portion adapted to restrict movement in the main scanning direction with respect to the holder unit when the first liquid supply unit is attached to the carriage unit, the second liquid supply unit has a second restriction portion adapted to restrict movement in the main scanning direction with respect to the first liquid supply unit when the second liquid supply unit is attached to the carriage unit, and the holder unit has a third restriction portion adapted to restrict movement in the main scanning direction with respect to the second liquid supply unit when the second liquid supply unit is attached to the carriage unit.

14. The liquid supply system according to claim 13, wherein when the first restriction portion and the second restriction portion are viewed in a plan view in the attaching direction in a state where the first liquid supply unit and the second liquid supply unit are attached to the carriage unit, positions of the first restriction portion and the second restriction portion in the main scanning direction are different from each other.

15. The liquid supply system according to claim 1, further comprising:

a third liquid supply unit having a third liquid supply portion adapted to supply third liquid to the carriage unit and adapted to be attached to and detached from the carriage unit independently of the first liquid supply unit and the second liquid supply unit, wherein when a direction in which the carriage unit scans is defined as a main scanning direction, the first liquid supply unit and the second liquid supply unit are configured to be arranged side-by-side in a direction orthogonal to the main scanning direction when the first liquid supply unit and the second liquid supply unit are attached to the carriage unit, the first liquid supply unit and the third liquid supply unit are configured to be arranged side-by-side in the direction orthogonal to the main scanning direction when the first liquid supply unit and the third liquid supply unit are attached to the carriage unit, and the second liquid supply unit and the third liquid supply unit are configured to be arranged side-by-side in the main scanning direction when the second liquid supply unit and the third liquid supply unit are attached to the carriage unit.

16. The liquid supply system according to claim 1, further comprising:

a liquid container; and a first liquid supply tube that connects the first liquid supply unit to the liquid container.

* * * * *